US005417545A

United States Patent [19]

Harrogate

[11] Patent Number: 5,417,545

[45] Date of Patent: May 23, 1995

[54] COOLED TURBINE NOZZLE ASSEMBLY AND A METHOD OF CALCULATING THE DIAMETERS OF COOLING HOLES FOR USE IN SUCH AN ASSEMBLY

[75] Inventor: Ian W. R. Harrogate, Derby, England

[73] Assignee: Rolls-Royce plc, London, England

[21] Appl. No.: 205,083

[22] Filed: Mar. 3, 1994

[30] Foreign Application Priority Data

Mar. 11, 1993 [GB] United Kingdom ..... 9305010

[51] Int. Cl.[6] ..... F01D 9/04; F01D 9/06

[52] U.S. Cl. ..... 415/115; 415/116; 60/39.32; 60/757

[58] Field of Search ..... 415/115, 116, 117, 180; 416/95, 96 R, 96 A, 97 R, 97 A; 60/39.75, 752, 755, 757, 39.32

[56] References Cited

U.S. PATENT DOCUMENTS

| | | | |
|---|---|---|---|
| 3,670,497 | 6/1972 | Sheldon | 415/115 |
| 4,187,054 | 2/1980 | Landis, Jr. et al. . | |
| 4,733,538 | 3/1988 | Vdoviak et al. | 60/752 |
| 4,798,514 | 1/1989 | Pask | 416/97 A |
| 4,821,522 | 4/1989 | Matthews et al. . | |
| 4,889,469 | 12/1989 | Wilkinson | 415/115 |
| 4,946,346 | 8/1990 | Ito | 415/115 |

FOREIGN PATENT DOCUMENTS

| | | |
|---|---|---|
| 0178242 | 4/1986 | European Pat. Off. . |
| 0501813 | 9/1992 | European Pat. Off. . |
| 980363 | 1/1965 | United Kingdom . |
| 1193587 | 6/1970 | United Kingdom . |
| 2107405 | 4/1983 | United Kingdom . |

OTHER PUBLICATIONS

2301 N.T.I.S. Tech Notes (Engineering) (1985) Jan., No. 1D, Springfield, Va., USA.

Walter Traupel, Thermische Turbomaschinen, Springer-Verlag Berlin Heidelberg New York 1977 and Tralslation No. G 3645—Walter Traupel.

Search Report Dated Jun. 16, 1994.

*Primary Examiner*—Edward K. Look
*Assistant Examiner*—Christopher Verdier
*Attorney, Agent, or Firm*—Cushman Darby & Cushman

[57] ABSTRACT

A turbine nozzle assembly includes an annular array of nozzle guide vanes located downstream of a combustor discharge casing. Each nozzle guide vane includes an aerofoil portion which is cast integrally with a radially inner platform and a radially outer platform. The radially outer platform of each nozzle guide vane has an extension to provide a smooth transition of the gases from the combustor discharge casing to the nozzle guide vanes. Two rows of cooling holes are provided in the extension to film cool the inner surface of the platform. A method is described to calculate the diameter of each of the cooling holes so that a uniform flow of cooling air passes over the inner surface of the each platform.

8 Claims, 4 Drawing Sheets

COOLED TURBINE NOZZLE ASSEMBLY AND A METHOD OF CALCULATING THE DIAMETERS OF COOLING HOLES FOR USE IN SUCH AN ASSEMBLY

FIELD OF THE INVENTION

The present invention relates to a turbine nozzle assembly and in particular to a turbine nozzle assembly for a gas turbine engine.

BACKGROUND OF THE INVENTION

A conventional axial flow gas turbine engine comprises, in axial flow series, a compressor section, a combustor in which compressed air from the high pressure compressor is mixed with fuel and burnt and a turbine section driven by the products of combustion.

The products of combustion pass from the combustor to the first stage of the turbine through an array of nozzle guide vanes. Aerodynamic losses are experienced as the products of combustion pass from the combustor to the nozzle guide vanes. The aerodynamic losses produce a circumferential pressure gradient close to the leading edge of the nozzle guide vane. This pressure gradient prevents cooling air from flowing uniformly over the platform of the nozzle guide vane. As the cooling air does not flow uniformly over the platform hot combustion gases can impinge on the platform surface and cause hot streaks on the platform of the nozzle guide vane. This is detrimental to component performance and life.

SUMMARY OF THE INVENTION

The present invention seeks to provide a turbine nozzle assembly in which the nozzle guide vanes have platforms which provide a smoother transition of the combustion products from the combustor to the nozzle guide vanes. The present invention also seeks to provide improved cooling of the platforms of the nozzle guide vanes to substantially minimize the damage caused by hot streaks on the platform surfaces.

According to the present invention a turbine nozzle assembly for a gas turbine engine comprises an annular array of nozzle guide vanes and combustor discharge means, the annular array of nozzle guide vanes being located downstream of the combustor discharge means, each nozzle guide vane comprising an aerofoil member respectively attached by its radial extents to a radially inner and a radially outer platform, the platforms of the nozzle guide vanes defining gas passage means for gases from the combustor discharge means, at least one of the platforms of the nozzle guide vanes having an upstream portion which extends towards the combustor discharge means to provide a smooth transition of the gases from the combustor discharge means to the nozzle guide vanes, the upstream portions of the platforms of the nozzle guide vanes having an at least one row of cooling holes therein through which in operation a flow of cooling air passes to film cool the platforms, the at least one row of cooling holes lying transverse to the direction in which the gases are discharged from the combustor discharge means, the cross-sectional areas of the cooling holes in the at least one row vary so that a uniform flow of cooling air passes over the platform.

Preferably the extended upstream portion of the at least one platform of the nozzle guide vane is provided with two rows of cooling holes to film cool the at least one platform. The rows of cooling holes are preferably provided in the extended upstream portion of the radially outer platform of the nozzle guide vane.

Preferably the cooling holes are circular and each cooling hole has a diameter which is different from the diameters of the other cooling holes in the at least one row.

Preferably the cooling air flow passes from a seal assembly for sealing between the combustor discharge means and the nozzle guide vanes to the row of cooling holes in the upstream portion of the platform of the nozzle guide vanes.

The downstream portion of the sealing assembly is in sealing relationship with the platform of the nozzle guide vane and an upstream portion of the seal assembly is in sealing relationship with the combustor discharge means to define a chamber through which the cooling air passes to the row of cooling holes.

According to a further aspect of the present invention a method is provided for calculating the optimum diameters of circular cooling holes in a platform of a nozzle guide vane which forms part of a turbine nozzle assembly. The method comprises the steps of, selecting a diameter for each of the holes which gives the required total mass flow over the platform surface, plotting the cooling air mass flow distribution through the holes of constant diameter, calculating the mean mass flow from the mass flow distribution, plotting a graph of mass flow verses the pressure ratio across each hole and area fitting a quadratic equation of the form $Y=aX^2+bX+c$ to the graph from which values for the constants a, b and c are derived, calculating the optimum diameter of each cooling hole by substituting the values for the constants a, b, c, the mean mass flow and the pressure ratio across a given hole into the equation:

$$d = \frac{2}{\sqrt{\pi}}\left[\frac{m}{a(PR)^2 + b(PR) + c}\right]^{\frac{1}{2}}$$

The present invention will now be more particularly described with reference to the accompanying drawings in which:

versus pressure ratio for a row of constant diameter holes in the platform of a nozzle guide vane.

DETAILED DESCRIPTION OF THE INVENTION

Figure 1:
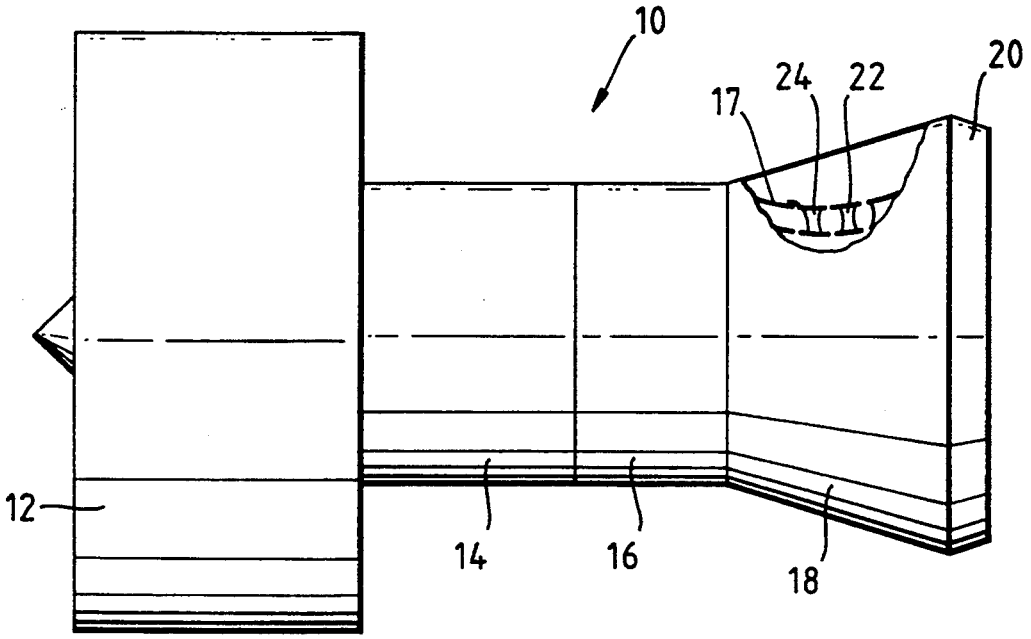
FIG. 1 shows diagrammatically an axial flow gas turbine engine.
Figure 3:
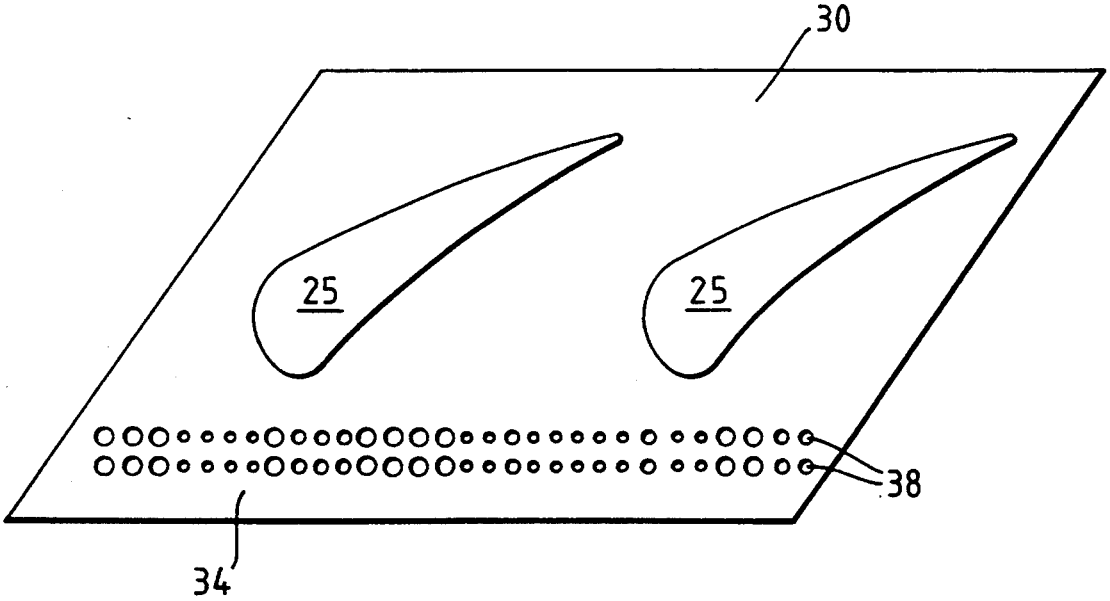
FIG. 3 a view in the direction of arrow A in FIG. 2.

Referring to FIG. 1 a gas turbine engine, generally indicated at 10, comprises a fan 12, a compressor 14, a combustor 16 and a turbine 18 in axial flow series.

The engine operates in conventional manner so that the air is compressed by the fan 12 and the compressor 14 before being mixed with fuel and the mixture combusted in the combustor 16. The hot combustion gases then expand through the turbine 18 which drives the fan 12 and the compressor 14 before exhausting through the exhaust nozzle 20.

An array of nozzle guide vanes 24 is located between the downstream end 17 of the combustion chamber 16 and the first stage of the turbine 18. The hot combustion gases are directed by the nozzle guide vanes 24 onto rows of turbine vanes 22 which rotate and extract energy from the combustion gases.

Figure 2:
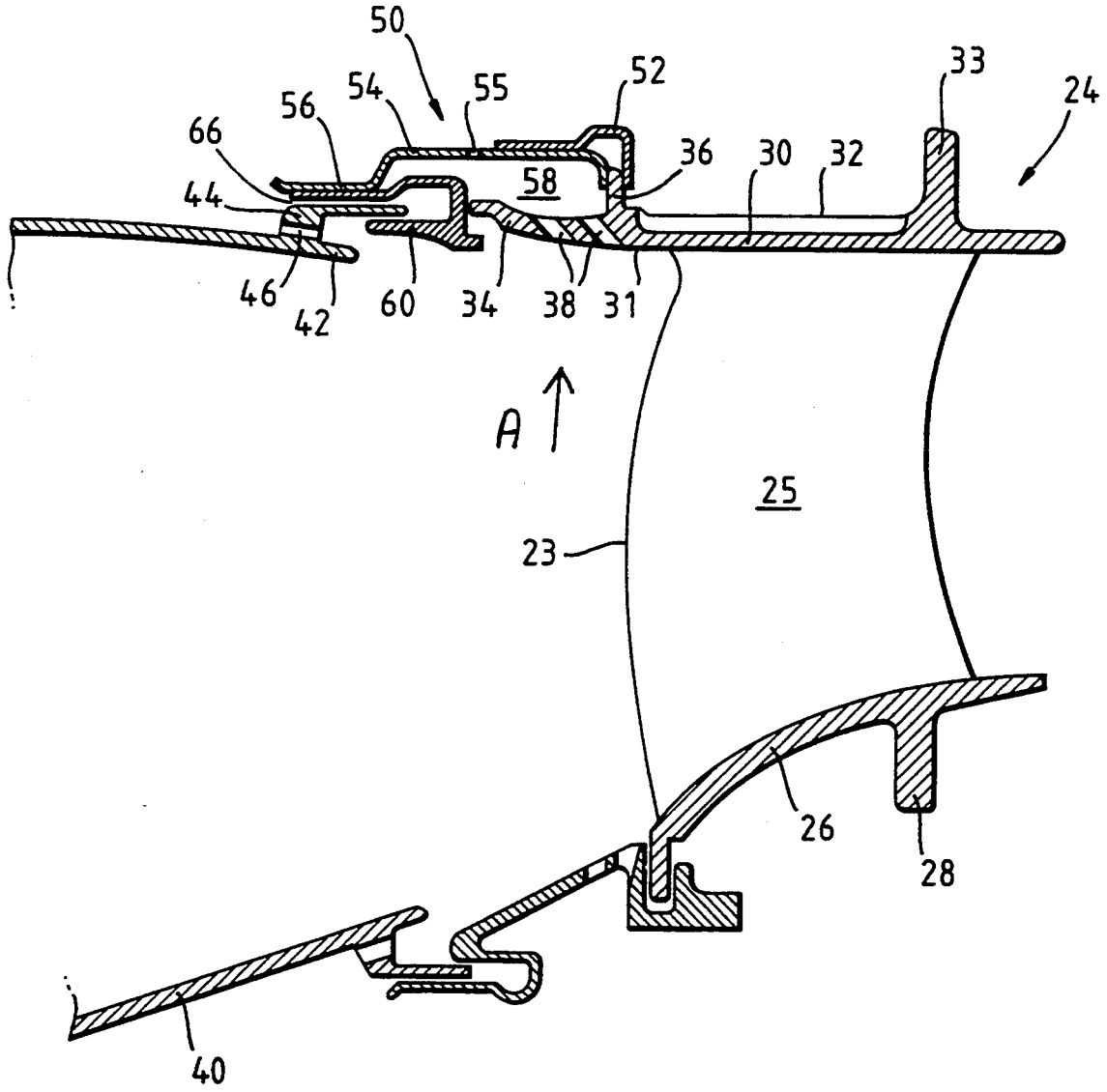
FIG. 2 shows a portion of a turbine nozzle assembly in accordance with the present invention.

Each nozzle guide vane 24, FIG. 2, comprises an aerofoil portion 25 which is cast integrally with a radially inner platform 26 and a radially outer platform 30. The platforms 26 and 30 are provided with dogs 28 and 33 respectively which are cross keyed in conventional manner to static portions of the engine 10 to locate and support the vanes 24.

The radially outer platform 30 of the nozzle guide vane 24 has a forwardly projecting extension 34 which extends towards a casing 40 of the combustor 16 through which the products of combustion are discharged. The platform extension 34 provides for a smoother transition of the flow of gases between the combustor discharge casing 40 and the nozzle guide vanes 24 and reduces the pressure gradient at the leading edge 23 of the nozzle guide vanes 24.

A seal assembly 50 is arranged to provide a seal between the outer platform 30 of the nozzle guide vane 24 and the combustor discharge casing 40. The seal assembly 50 comprises outer and inner ring members, 52 and 54 respectively. The ring members 52 and 54 are secured together and clipped over a short radially projecting flange 36 on the outer surface 32 of the radially outer platform 30 of each nozzle guide vane 24. The inner ring 54 is stepped and the radially inner portion 56 is secured to an innermost ring 60. The innermost ring 60 has two axially extending portions which define an annular slot 66 which locates on a flange 44 provided on the downstream end 42 of the combustor discharge casing 40. Sufficient clearance is left between the flanges to allow for relative movement between the components during normal operation of the engine. Surfaces of the flanges likely to come into contact with each other are given anti-fretting coatings C.

The flange 44 on the downstream end 42 of the combustor discharge casing 40 has a circumferentially extending row of cooling holes 46. The cooling air holes 46 are situated to allow cooling air to flow over the inner surface 31 of the extension 34 to the radially outer platform 30 of the nozzle guide vane 24.

The seal assembly 50 defines a chamber 58 to which a flow of cooling air is provided. The cooling air is provided to the chamber 58 through circumferentially extending cooling holes 55 in the inner ring 54 of the seal assembly 50. The cooling air passes from the chamber 58 through two axially consecutive circumferentially extending rows of angled holes 38 in the platform extension 34. The two rows of cooling holes 38 in the platform extension 34 film cool the inner surface 31 of the outer platform 30 of the nozzle guide vane 24, thereby supplementing and renewing the cooling air film already produced by the flow through the cooling holes 46 in the flange 44 on the downstream end 42 of the combustor discharge casing 40.

To overcome the problem of the circumferential pressure gradients close to the leading edge 23 of the nozzle guide vane 24 and so provide an even distribution of cooling air flow over the inner surface 31 of the platform 30 of the nozzle guide vane 24 the diameter of each cooling hole 38 in the platform extension 34 varys. The diameter of each cooling hole 38 is modified so that a more uniform mass flow of cooling air per surface area is presented to the platform surface 31.

In the preferred embodiment of the present invention the cooling holes 38 are circular and the diameter of each cooling hole 38 in the platform extension 34 is different. However for ease of manufacture each row of cooling holes may be arranged in sets, each set of holes has a different diameter but within each set the diameters of the holes 38 are the same. Other shapes of cooling holes 38 may also be used, the cross-sectional areas of which vary to provide a more uniform flow of cooling air across the platform surface 31.

A method is described to calculate a diameter for each circular hole 38 which will pass the ideal mass flow.

Figure 4:
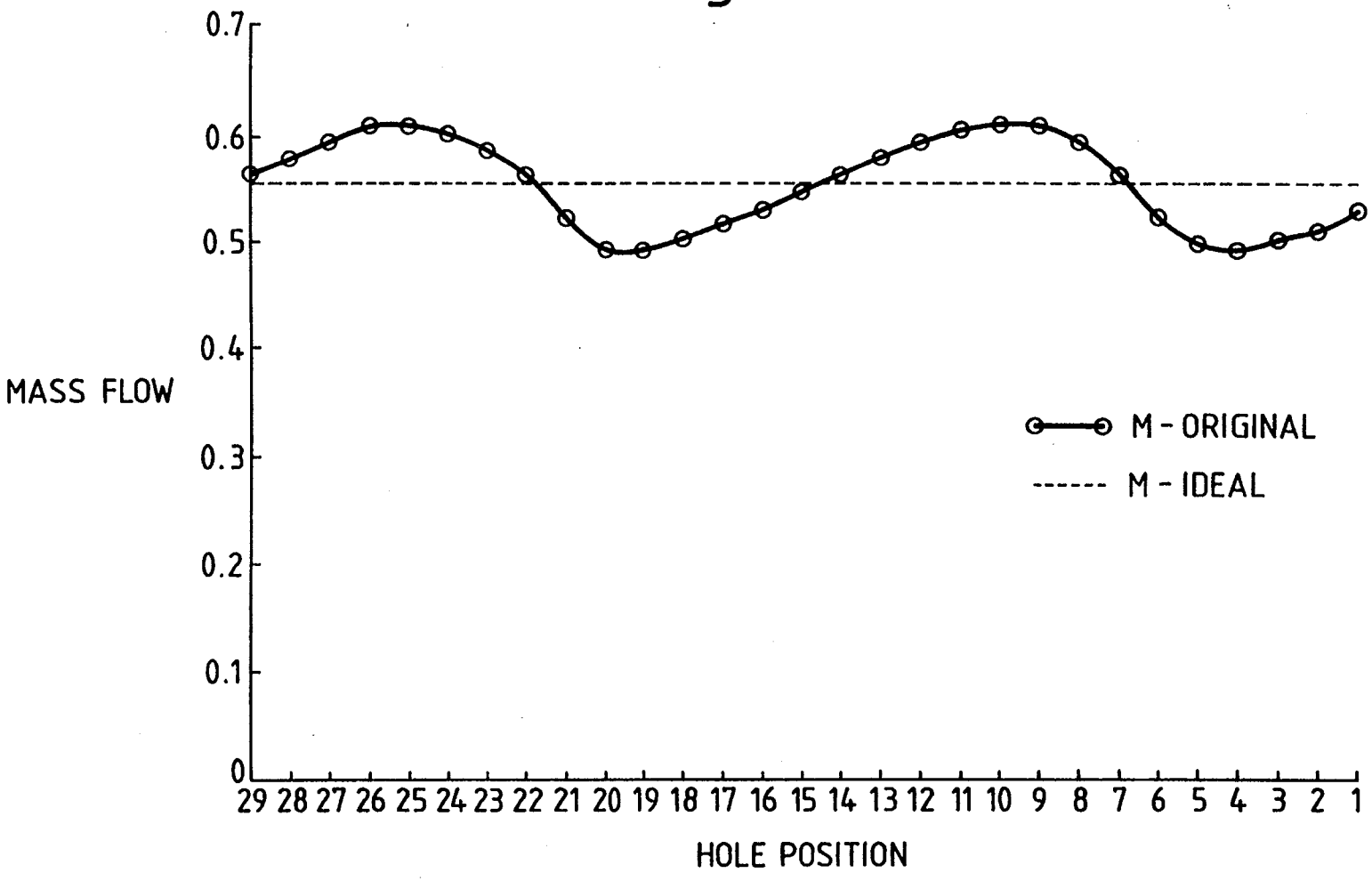
FIG. 4 shows the mass flow distribution that results from a row of constant diameter holes in the platform of a nozzle guide vane.

Initially the same diameter is chosen for all the holes 38 to give the required total mass flow over the surface 31 of the platform 30. Although all the holes 38 have the same diameter the mass flow of air passing through each hole 38 varies due to the pressure gradient at the leading edge 23 of the nozzle guide vane 24. The pressure gradient produces a mass flow distribution from the row of holes 38 having the same diameters as shown in FIG. 4. The variation in the mass flow is meaned to give an ideal mass flow value for each hole 38.

Figure 5:
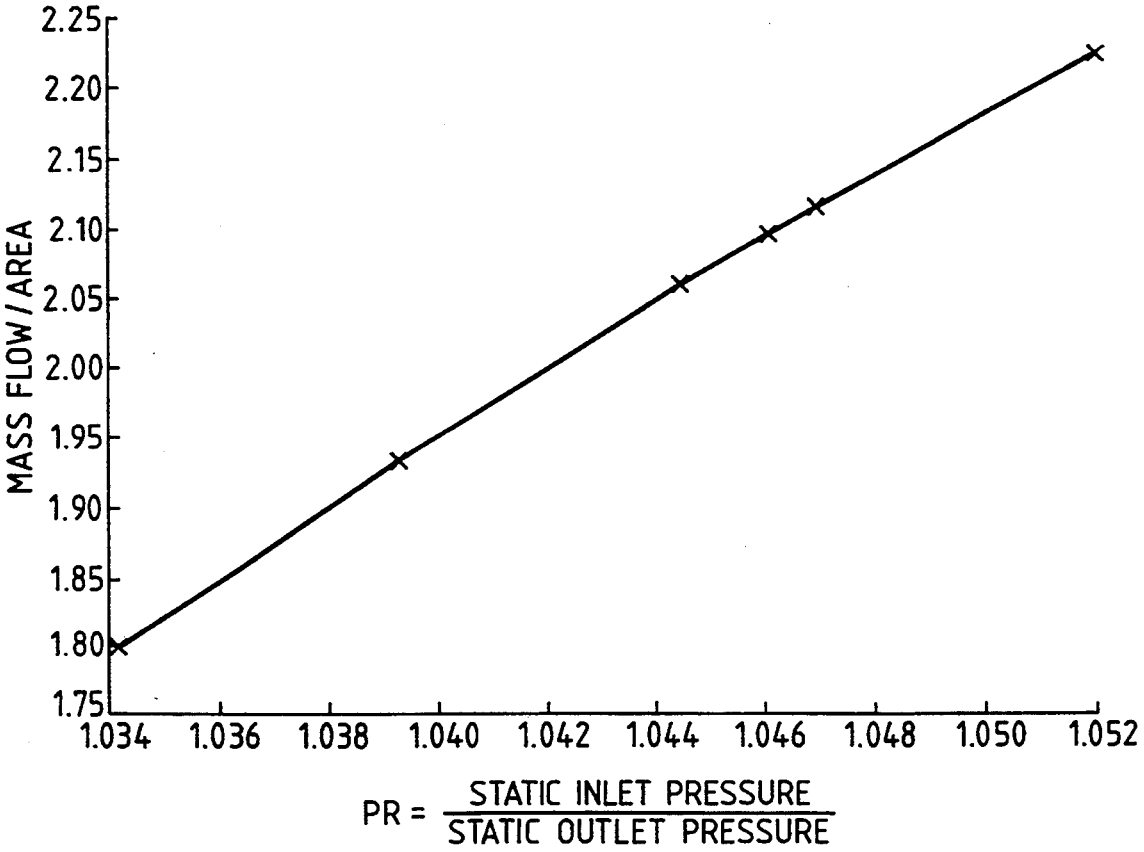
FIG. 5 is a graph of $$\frac{\text{mass flow}}{\text{area}}$$

To establish a diameter for each hole 38 which will pass the ideal mass flow a graph is plotted of $$\frac{m\ (\text{mass flow})}{A\ (\text{area})} \text{ versus } \frac{\text{static inlet pressure}}{\text{static outlet pressure}}$$

for each hole of constant diameter (FIG. 5). A quadratic equation is fitted through these points and gives equation (1):

$$\frac{m}{A} = -0.0018949(PR)^2 + 0.0041938(PR) - 0.0022925$$

where m=mass flow

A=area of the hole $$PR = \text{pressure ratio } \frac{(\text{static inlet pressure})}{(\text{static outlet pressure})}$$

Re-arranging and substituting for area in equation (1) gives equation (2):

$$d = \frac{2}{\sqrt{\pi}}\left[\frac{m}{-0.0018949(PR)^2 + 0.0041938(PR) - 0.0022925}\right]^{\frac{1}{2}}$$

where d=hole diameter m=mass flow $$PR = \text{hole pressure ratio } \frac{(\text{static inlet pressure})}{(\text{static outlet pressure})}$$

By substituting into equation (2) the value for the ideal mass flow and the pressure ratio across each hole 38 the optimum diameter of each hole 38 can be established. A hole 38 with the optimum diameter passes the ideal mass flow to ensure uniform cooling of the surface 31 of the platform 30.

It will be appreciated by one skilled in the art that this method can be used to calculate the optimum diameters for cooling holes in the platform of any nozzle guide vane. In each case a diameter is chosen for all the holes which gives the required total mass flow of cooling air over the platform. A plot of the mass flow distribution from these holes is used to establish the ideal mass flow through each hole. A quadratic equation of the form $$Y=aX^2+bX+c$$

is fitted to a plot of $$\frac{m}{A}$$

verses pressure ratio PR. Values for the constants a, b and c are taken from the graph. The optimum hole diameter can then be calculated for a given nozzle guide vane by substituting the values of the constants a, b, c, the ideal mass flow m and the pressure ratio PR into the equation;

$$d=\frac{2}{\sqrt{\pi}}\left[\frac{m}{a(PR)^2+b(PR)+c}\right]^{\frac{1}{2}}$$

What is claimed is:

1. A cooled turbine nozzle assembly for a gas turbine engine comprising an annular array of nozzle guide vanes and combustor discharge means, the annular array of nozzle guide vanes being located downstream of the combustor discharge means, each nozzle guide vane comprising an aerofoil member attached by its radial extents to a radially inner and radially outer platform, the platforms of the nozzle guide vanes defining gas passage means for gases from the combustor discharge means, at least one of the platforms of the nozzle guide vanes having an upstream portion which extends towards the combustor discharge means to provide a smooth transition of the gases from the combustor discharge means to the nozzle guide vanes, the upstream portion of the at least one platform of the nozzle guide vanes having an at least one row of cooling holes therein through which in operation a flow of cooling air passes to film cool the platforms, the at least one row of cooling holes lying transverse to the direction in which the gases are discharged from the combustor discharge means, the cross-sectional areas of the cooling holes in the at least one row vary so that a uniform flow of cooling air passes over the at least one platform.

2. An assembly as claimed in claim 1 in which the extended upstream portion of the at least one platform of the nozzle guide vanes is provided with two rows of cooling holes to film cool the at least one platform.

3. An assembly as claimed in claim 1 in which the at least one row of cooling holes is provided in the radially outer platform of the nozzle guide vanes.

4. An assembly as claimed in claim 1 in which the cooling holes are circular.

5. An assembly as claimed in claim 4 in which each circular cooling hole has a diameter which is different from the diameters of the other circular cooling holes in the at least one row.

6. An assembly as claimed in claim 1 in which the cooling air flow passes from a seal assembly for sealing between the combustor discharge means and the nozzle guide vanes to the row of cooling holes in the upstream portion of the at least one platform of the nozzle guide vanes.

7. An assembly as claimed in claim 6 in which the downstream portion of the seal assembly is in sealing relationship with the at least one platform of the nozzle guide vanes and the upstream portion of the seal assembly is in sealing relationship with the combustor discharge means to define a chamber through which the cooling air passes to the row of cooling holes.

8. A method of forming circular cooling holes of optimum diameters in a platform of a nozzle guide vane forming part of a turbine nozzle assembly, where the holes, in operation, allow a required total mass cooling air flow over the platform comprising the steps of: plotting the cooling air mass flow distribution through holes of constant diameter, calculating a mean mass flow from the cooling air mass flow distribution, plotting a graph of mass flow/area versus the pressure ratio across each hole and fitting a quadratic equation of the form $Y=aX^2+bX+c$ to the graph from which values for the constants a, b and c are derived, calculating the optimum diameter for each cooling hole by substituting the values for the constants a, b and c, the mean mass flow and the pressure ratio across a given hole into the equation:

$$d=\frac{2}{\sqrt{\pi}}\left[\frac{m}{a(PR)^2+b(PR)+c}\right]^{\frac{1}{2}}$$

where PR is the pressure ratio, m is the ideal mass flow and forming each hole with a diameter d as calculated.

* * * * *